US005118230A

United States Patent [19]

Justice

[11] Patent Number: 5,118,230

[45] Date of Patent: Jun. 2, 1992

[54] METHOD AND APPARATUS FOR INSTALLATION OF LEACHATE CONTAINMENT SYSTEM

[76] Inventor: Donald R. Justice, P.O. Box 458, Matlacha, Fla. 33909

[21] Appl. No.: 634,686

[22] Filed: Dec. 27, 1990

[51] Int. Cl.[5] ..... E02D 31/00

[52] U.S. Cl. ..... 405/128; 405/176; 405/267

[58] Field of Search ..... 405/36, 50, 115, 128, 405/129, 176, 267

[56] References Cited

U.S. PATENT DOCUMENTS

| | | | |
|---|---|---|---|
| 3,182,459 | 5/1965 | Grether et al. . | |
| 4,252,462 | 2/1981 | Klingle et al. . | |
| 4,296,884 | 10/1981 | Luebke . | |
| 4,337,006 | 6/1982 | Lacey | 405/176 |
| 4,352,601 | 10/1982 | Valiga et al. . | |
| 4,358,221 | 11/1982 | Wickberg . | |
| 4,366,846 | 1/1983 | Curati, Jr. . | |
| 4,458,456 | 7/1984 | Battle | 405/115 X |
| 4,482,835 | 11/1984 | Van Klinken . | |
| 4,543,016 | 9/1985 | Tallard . | |
| 4,607,981 | 8/1986 | Van Klinken . | |
| 4,720,212 | 1/1988 | Steenbergen et al. . | |
| 4,741,644 | 5/1988 | Cavalli et al. | 405/50 |
| 4,806,043 | 2/1989 | Fournier | 405/176 X |
| 4,863,312 | 9/1989 | Calalli | 405/128 |
| 4,877,358 | 10/1989 | di Cervia | 405/267 |

FOREIGN PATENT DOCUMENTS

| | | | |
|---|---|---|---|
| 618481 | 8/1978 | U.S.S.R. | 405/115 |

*Primary Examiner*—David H. Corbin

*Attorney, Agent, or Firm*—Fleit, Jacobson, Cohn, Price, Holman & Stern

[57] ABSTRACT

A trenching tool which digs a trench to depths of six to thirty feet. A liner carrier case is conveyed to the trench bottom from which is withdrawn an impermeable barrier liner; extended from the bottom to the top of the excavated trench. The liner casing is positioned at the trench bottom and forms a bottom seal for a vertical liner. The impermeable liner is deployed simultaneously with the trenching operation. The trenching, liner and bottom seal positioning of the liner casing, and backfilling, is all part of a coordinated operation.

16 Claims, 6 Drawing Sheets

METHOD AND APPARATUS FOR INSTALLATION OF LEACHATE CONTAINMENT SYSTEM

FIELD OF THE INVENTION

This invention relates to a method and an apparatus for installation of a leachate containment system for protection from contamination of surface and ground water.

BACKGROUND OF THE INVENTION

There is a great demand for protection of potable water from contamination with impurities. Basic movement of water in the earth's soil, either vertically or horizontally, when interfaced with a source of contamination, requires that the contamination be contained and that any contaminated water be recovered and treated to an acceptable standard so that the recovered water can be reintroduced into the water cycle. Great efforts have been expended to design and construct various leachate and polluted water containments, coupled with recovery and treatment methods for these waters.

Various attempts have been made to effectuate this goal by a leachate containment system. Some examples are:

U.S. Pat. No. 4,252,462 to Klingle et al. discloses a landfill for permanent disposal of waste water sludge. An impoundment area is formed having a base that is substantially liquid impervious. A liquid collection system and conveyance is installed in liquid pervious materials which overlay the impervious base. The landfill is designed to be closed after sludge is dewatered by spreading a liquid impervious layer over the dewatered sludge.

U.S. Pat. No. 4,296,884 to Luebke discloses a containment reservoir and method. A reservoir is constructed of an impervious liner following the contours of earthen construction and having a covering layer of pervious fabric material for filtering liquids passing into the reservoir. This system includes drain recovery pipes which provide that liquid that is caught in the reservoir will drain by gravity down through a drain section, down a passageway where it is removed by gravity to a more remote location or storage facility. The system is a fully constructed system located only a few feet in depth from normal land surface elevation and is primarily addressed at retaining or salvaging spilled oil along a railroad track environment.

U.S. Pat. No. 4,352,601 to Valiga et al. discloses a permanent bin for temporary storage of hazardous materials. This is a fully constructed system which is to be installed at a level which is above the high water table level in the region.

The system incorporates an excavated basin, drainage trench, and a continuous preformed liner of water impervious plastic, or asphaltic liquids applied in sufficient depth to establish a suitable water impervious barrier. A drainage collection system, including perforated pipes, is installed in the drainage ditch. A cementitious covering forming an impervious layer is placed over the plastic or asphaltic liner in berm slopes. The drainage pipe is sealed from the containment by the liner and cementitious covering and is used for monitoring of leakage from the constructed storage bin. The drainage flows by gravity to a collector pump located outside the perimeter wall. This system is a fully constructed storage barrier to contain hazardous wastes placed therein and is designed to contain 100% of material, liquid or otherwise, and a monitoring method for leakage.

U.S. Pat. No. 4,358,221 to Wickberg discloses a system for pollution control. This system relates to dump sites for chemical and toxic wastes which avoid the usual problems of chemical pollution of ground water. The system is installed in areas where there exists impermeable layers of clay or other materials which preclude the need for bottom lining.

The system includes a precast section of tongue and groove concrete barrier walls to complete the sealed containment. The containment is extended to the aquaclude and driven into place. Vertical sand filled columns are interconnected by gravel filled rows forming a common drainage network to a collection pit. This system provides for a place to deposit waste slurries and leachate collecting therefrom by wicks interconnected and gravity conveyed to a collector pit for removal.

U.S. Pat. No. 4,366,846 to Curati, Jr., discloses a method for collecting and storing liquid from along a railroad track section. This system provides for a containment and storage system for liquids.

The system includes a walled containment reservoir formed underground by means of an impervious liner and a receiving and storage area. Parallel perforated collecting pipes are interconnected and gravity fed to common manhole reservoirs which become pump out points for the collected liquids. The collecting pipes are covered by a pervious layer of non-woven fabric material as a filter.

Some examples of a system for installation of a leachate containment system are:

U.S. Pat. No. 3,182,459 to Grether et al., provides for forming of a continuous opening in the soil along a path where one desires to erect a water barrier, positioning a continuous sheet of plastic film vertically above the soil opening with the lower edge of the film extending into the opening, partly or completely filling the soil opening to form a substantially fluid-tight seal between the plastic film and the soil, and positioning rigid uprights adjacent the soil opening and fastening the vertically disposed film to the uprights.

This system is primarily addressed to extend the barrier above the ground surface for impounding water on the surface and having reinforcement staking for this purpose. The barrier seal into the ground surface is less than the portion supported by the stakes above ground. Further, the trench for the buried barrier is about 1½ inches wide and about 9 inches deep. This system is specifically for a synthetic levee for rice fields. All of the plastic film handling is primarily at ground level and at very shallow depths.

U.S. Pat. No. 4,337,006 to Lacey discloses a device for preparing and cleaning a trench for an aquifer recharging system. This system provides a means of lining a trench on one or both walls with a membrane impervious to water so that water can be confined either in a specific place or outside a certain space. The device may be used in conjunction with a trencher and requires no separate power means although it may also be used separately. The lining mechanism is rolls of impermeable liner material encased in a trench box, with seals to prevent soil intrusion. The liner material is fed out into position to line the trench wall or walls, as may be desired.

The trench is filled with pea gravel above the natural soil's gravel pack and topped with a fine filter sand bed.

The cleaning of the aquifer recharge bed is addressed to surface sediments collected on the top filter sand bed. It is a hooded device of sufficient width to cover the width of the filter bed trench, an agitator, and vacuum pump which lifts the impurities (sediments). Water is entrained and passes through a separating device which floats off and captures the filtered sand for replacement on the trench.

This system requires an open free-standing ditch to accommodate the liner placement box, subsequently backfilled with imported selected materials and does not require a bottom sealing method to the parent soils encountered. The cleaning mechanism requires the filter trench to be submerged and special surface constructed and maintained concrete curbings on which the cleaning and liner mechanism may travel.

U.S Pat. No. 4,484,835 to van Klinken discloses a method and apparatus for installing a ground water barrier. This system provides for the insertion of vertical sheets of material of an impervious nature by a lance which is vibrated into the ground to the desired depth. The width of the sheet and the lance, respectively, is at least one meter and preferably many meters. The sealing method of the vertical joints is possible by the overlapping and soil pressure seals, inflatable end strips, or by filling end strips with a solution which expands and hardens into place. The system utilizes a movable crane with a crane jib and a vibrating mechanism attached thereto.

U.S. Pat. No. 4,607,981 to van Klinken discloses a method for constructing a screen that obstructs the flow of subsoil water. This system is an improvement on van Klinken's earlier patent and is addressed towards a better method of vertical joint sealing. This system provides for an interlocking of the vertical panel edges in the manner of standard sheet piling, to resist separation thereof.

U.S Pat. No. 4,720,212 to Steenbergen et al. discloses a method and appliance for laying a sheet of material in the ground. By this system, a sheet of material is laid in the ground by digging a trench in the ground by a trench digger and unwinding the sheet of material from a stock roll above ground level, passing the sheet of material into the trench in a downward direction and diverting it in a direction essentially parallel to the ground level.

The sheet material is impervious or pervious filter cloth material which is laid flat at the bottom of an inverted "T" trench. The inverted "T" trench is formed by a digging beam provided at its lower end with laterally projecting digging screws. A protective housing includes a cross section in the form of an inverted "T".

The sheet material is carried by the trencher in rolls and is folded as it is fed into the trench box and unfolded and laid flat and horizontally at the bottom of the inverted "T" trench. No provision is made for joining a vertical wall installation to the horizontally flat sheet material.

U.S. Pat. No. 4,543,016 to Tallard discloses an underground leachate barrier and method of making same. This system provides for an impermeable barrier to be installed in a trench, securing the barrier by an impervious plug on the trench bottom and installing a drainpipe and filter gravel as trench/collection components.

This process includes an excavation of an open trench area, an installation of a liner on a good water side in the trench excavation and filling the trench with biodegradable slurry, pouring pelletized bentonite, expansive clay, or resin emulsion into the trench bottom in a slurry form to form a bottom plug seal, installation of a collector header and periodic risers, and backfilling pervious filter gravel into the trench where it is mixed with the biodegradable slurry. The trench depth is to impermeable soils or aqualude.

The foregoing patents are addressed to limited applications seeking to provide total containment with extensive, costly construction processes, most of which are surface area oriented.

SUMMARY OF THE INVENTION

The present invention includes the use of a trenching tool, which can dig a trench to depths of six feet to thirty feet. A liner carrier case is conveyed to the trench bottom from which is withdrawn an impermeable barrier liner; extended from the bottom to the top of the excavated trench. The liner casing is positioned at the trench bottom and forms a bottom seal for a vertical liner.

The impermeable liner is deployed simultaneously with the trenching operation. The trenching, liner and bottom seal positioning of the liner casing, and backfilling, is all part of a coordinated operation.

The liner carrier case is constructed of water impermeable material that is flexible in nature and of chemical composition to prevent deterioration. The bottom of the liner carrier case is thicker than its sides and top. This allows the bottom of the liner carrier case to be both the anchor point for a vertically extending impermeable barrier liner and a permanent seal of a peripheral containment barrier. The top of the liner carrier case is slotted to allow the enclosed impermeable barrier material to be withdrawn therefrom during the trenching and installation operation.

A trencher feed tube is mounted on the trenching tool. The feed tube is made of rigid steel plate which allows the liner carrier case, with its contained impermeable barrier liner, to be uniformly transported into its vertically extending ground position. The feed tube provides rigidity, protection and ultimate release into the final position at the trench bottom of the liner carrier case for attendant bottom anchoring and seal.

The impermeable barrier material is of a thickness (ASTM approved) and of chemical composition to prevent decomposition. The impermeable barrier material is folded into place within the liner carrier case during the liner carrier case manufacturing and packaging process. The last fold of the impermeable barrier material is heat fused to the bottom panel of the liner carrier case to provide the required continuity to the final in place anchor and sealing of the vertical impermeable barrier liner.

The liner carrier case and its contained impermeable barrier material is manufactured and transported to a job site in rolls of 500 to 1,000 linear feet, for simplicity in handling and ease of installation by a trenching tool. The length of the rolls are sufficient to minimize field heat fused seams between adjacent liner carrier case sections and adjacent impermeable barrier liner sections.

The top edge catch extending from the trencher feed tube is a rigid, slotted tube having a slot at its bottom surface, which allows a top edge of the impermeable barrier material to be fed into, through and out of the top edge catch during the trenching and installation operation. The top edge of the impermeable barrier material includes a continuous, solid, circular enlargement having a diameter exceeding the width of the slot of the top edge catch so that the top edge of the impermeable barrier material is fed into the top edge catch continuously and uniformly as the trenching and liner feed operation progresses.

A soil retainment device mounted laterally from a trench boom cutter head extends into the trench at a full depth and width of the trench. The height of the soil retainment device accommodates placement of the trench boom cutter head at angles of 45° to 90° with respect to the drive apparatus of the trenching tool. The soil retainment device allows progressive extension and placement of an impermeable barrier material having a bottom anchor/seal unit within an open trench containment area to minimize and eliminate ground friction, soil and extension damage. The soil retainment device allows continuous visual verification of full extension of the impermeable barrier material and provides the flexibility to provide various backfilling opportunities, if the replacement of the excavated soil is deemed unsuitable for backfill purposes. The top feed catch is supported by the soil retainment device for release of the top edge of the impermeable barrier liner by allowing the solid circular enlargement of the liner to slip free of the top edge catch and repose in its extended state.

It is an object of the present invention to provide a trenching tool mechanism having a soil retainment device mounted on a trench boom cutter head, through which a liner carrier case having a folded impermeable barrier liner is passed, with the liner being withdrawn from the carrier case to form a leachate containment system.

It is another object of the present invention to provide a trenching tool mechanism having a soil retainment device mounted on a trench boom cutter head, through which a liner carrier case having a folded impermeable barrier liner is passed, with the liner being withdrawn from the carrier case to form a leachate containment system with the carrier case forming a bottom seal of the trench within which a vertical liner has been extended.

It is yet another object of the present invention to provide a trenching tool mechanism having a soil retainment device mounted on a trench boom cutter head, through which a liner carrier case having a folded impermeable barrier liner is passed, with the liner being withdrawn from the carrier case to form a leachate containment system with the carrier case forming a bottom seal of the trench within which a vertical liner has been extended and the liner being extended within a trench surrounding a site of contaminants.

It is still yet another object of the present invention to provide a trenching tool mechanism having a soil retainment device mounted on a trench boom cutter head, through which a liner carrier case having a folded impermeable barrier liner is passed, with the liner being withdrawn from the carrier case to form a leachate containment system with the carrier case forming a bottom seal of the trench within which a vertical liner has been extended and the liner being extended within a trench surrounding a site of contaminants with a horizontally extending perforated pipe located below the contaminated site and within the impermeable barrier liner to lower the ground water level inside the containment area to a level that is less than the ground water level outside the containment area so as to create inflow of water under the barrier liner towards the perforated pipe to ensure against escape of contaminated leachate from the contaminated site.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
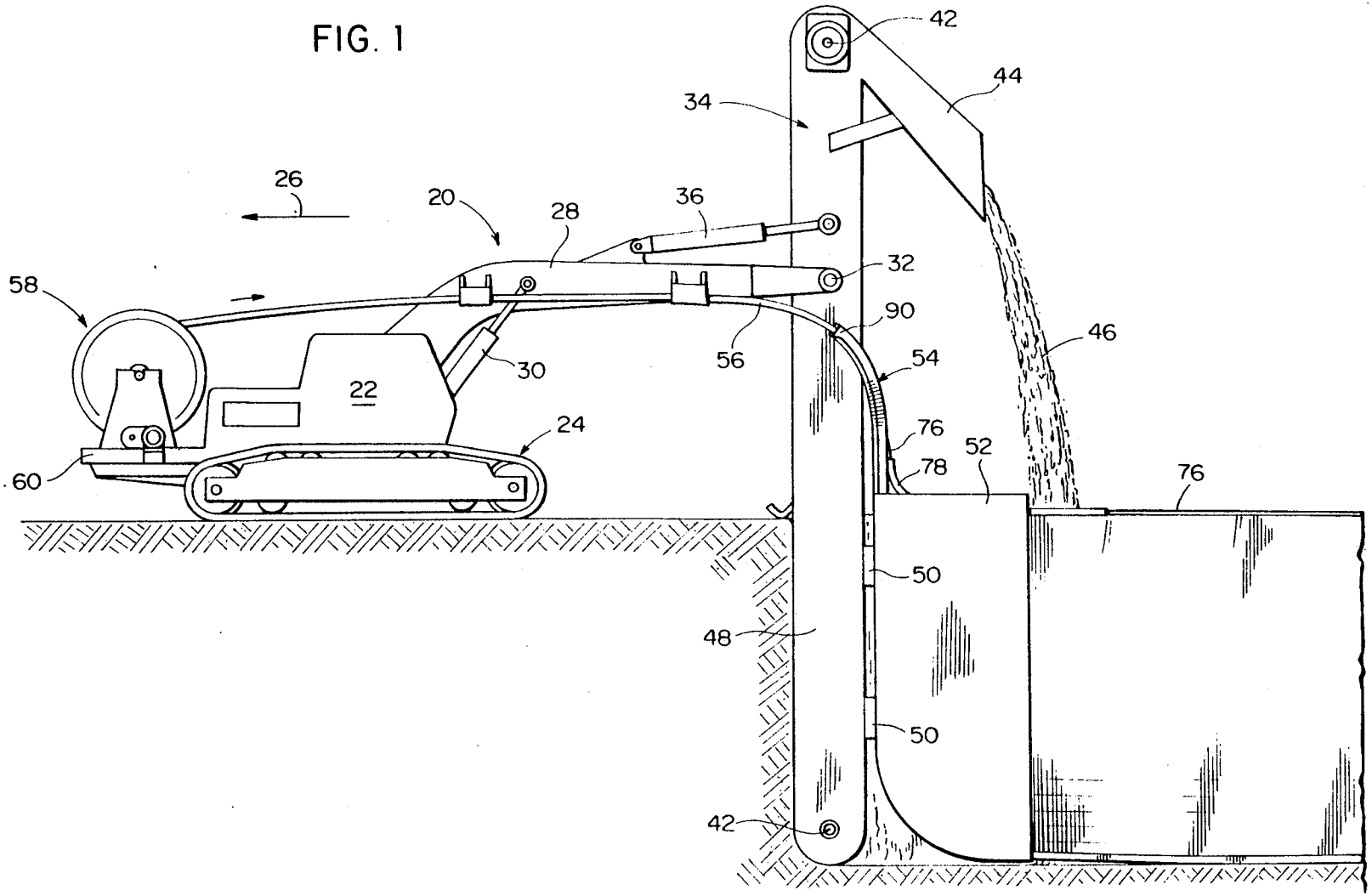
FIG. 1 is a side elevation view of a trenching tool mechanism installing a leachate containment system.
Figure 3:
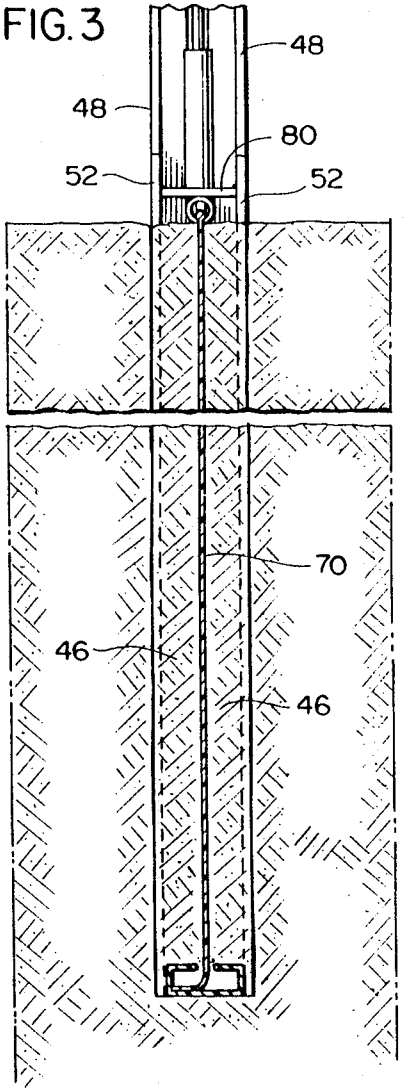
FIG. 3 is a longitudinal section taken along line 3—3 of FIG. 2.
Figure 2:
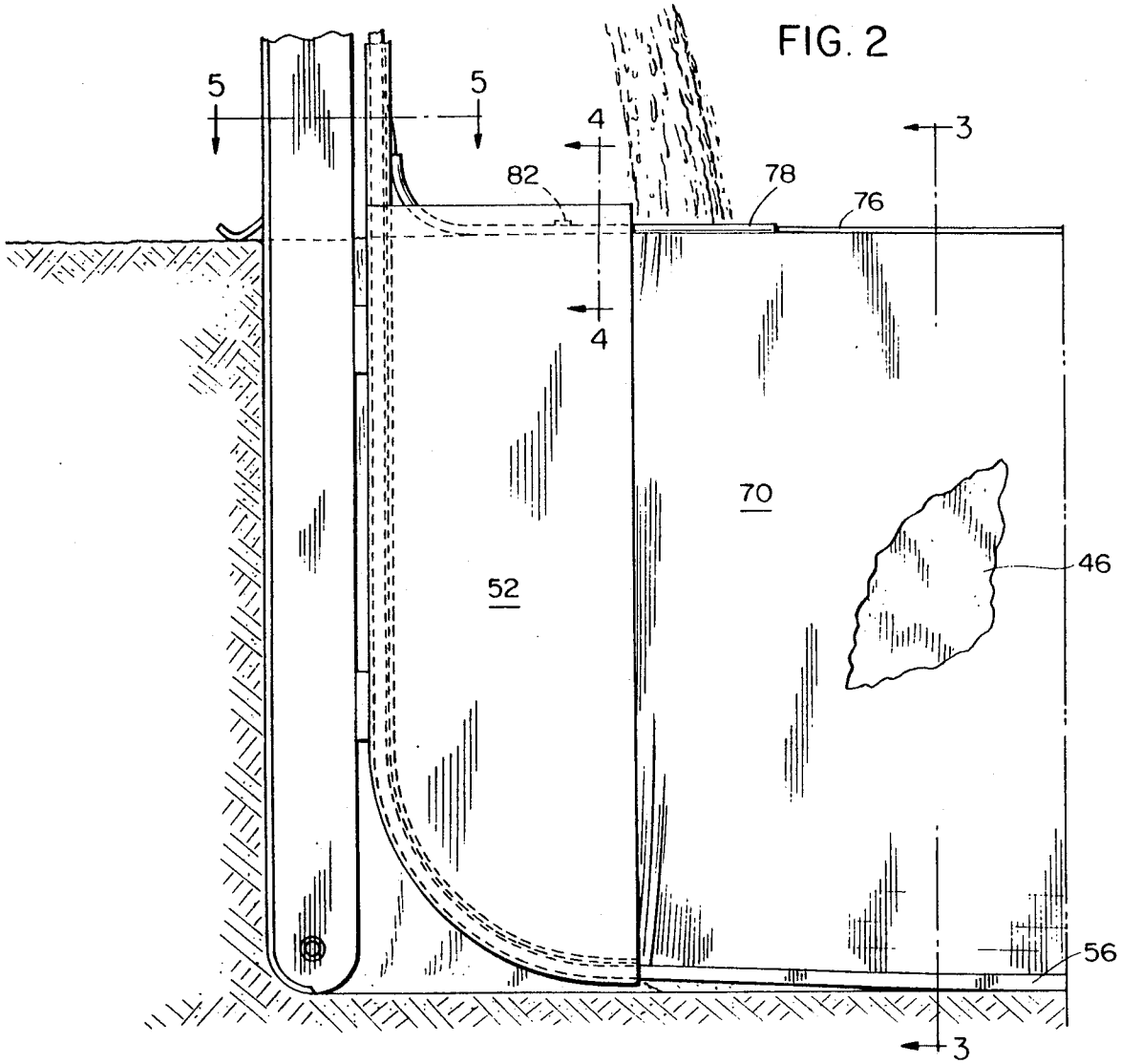
FIG. 2 is a enlarged side elevation, partly in section, of an impermeable barrier liner being positioned within a trench.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 8, in particular, a trenching tool mechanism 20 is shown which is similar to my U.S. Pat. No. 4,871,281. The trenching tool mechanism 20 is used for the installation of a leachate containment system.

The trenching tool mechanism 20 includes a cab 22 mounted on a track drive mechanism 24 for moving the trenching tool 20 in the direction of arrow 26.

Pivotally mounted on the cab 22 is boom 28. A hydraulic piston cylinder assembly 30 is pivotally mounted on the boom 28 and the cab 22 for raising and lowering the boom 28.

Located at an opposite end 32 of the boom 28 from the cab 22 is a trenching tool 34. A hydraulic piston cylinder assembly 36 pivotably mounts the trenching tool 34 on the boom 28.

Figure 5:
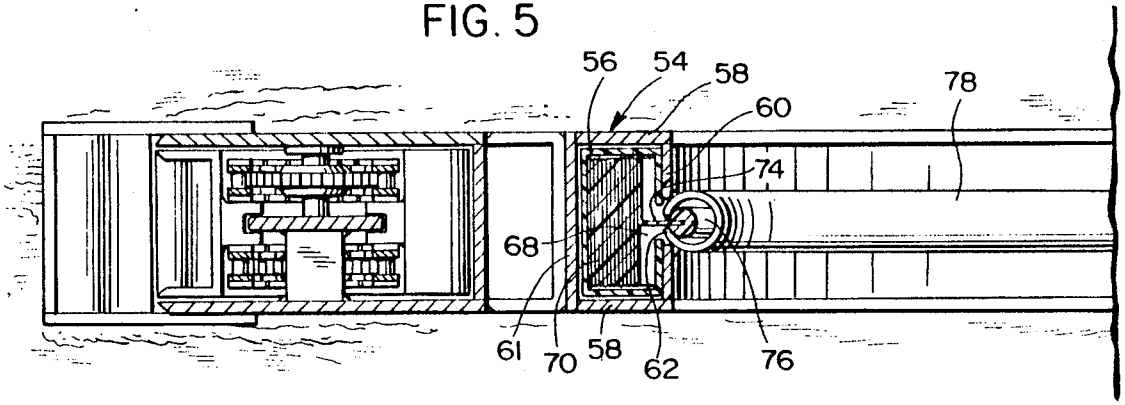
FIG. 5 is a cross section taken along line 5—5 of FIG. 2.
Figure 7:
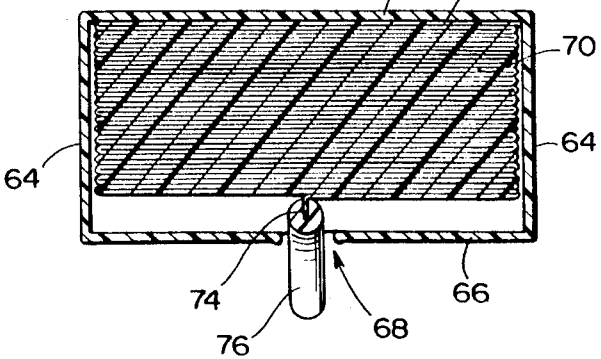
FIG. 7 is a cross section taken along line 7—7 of FIG. 6.
Figure 8:
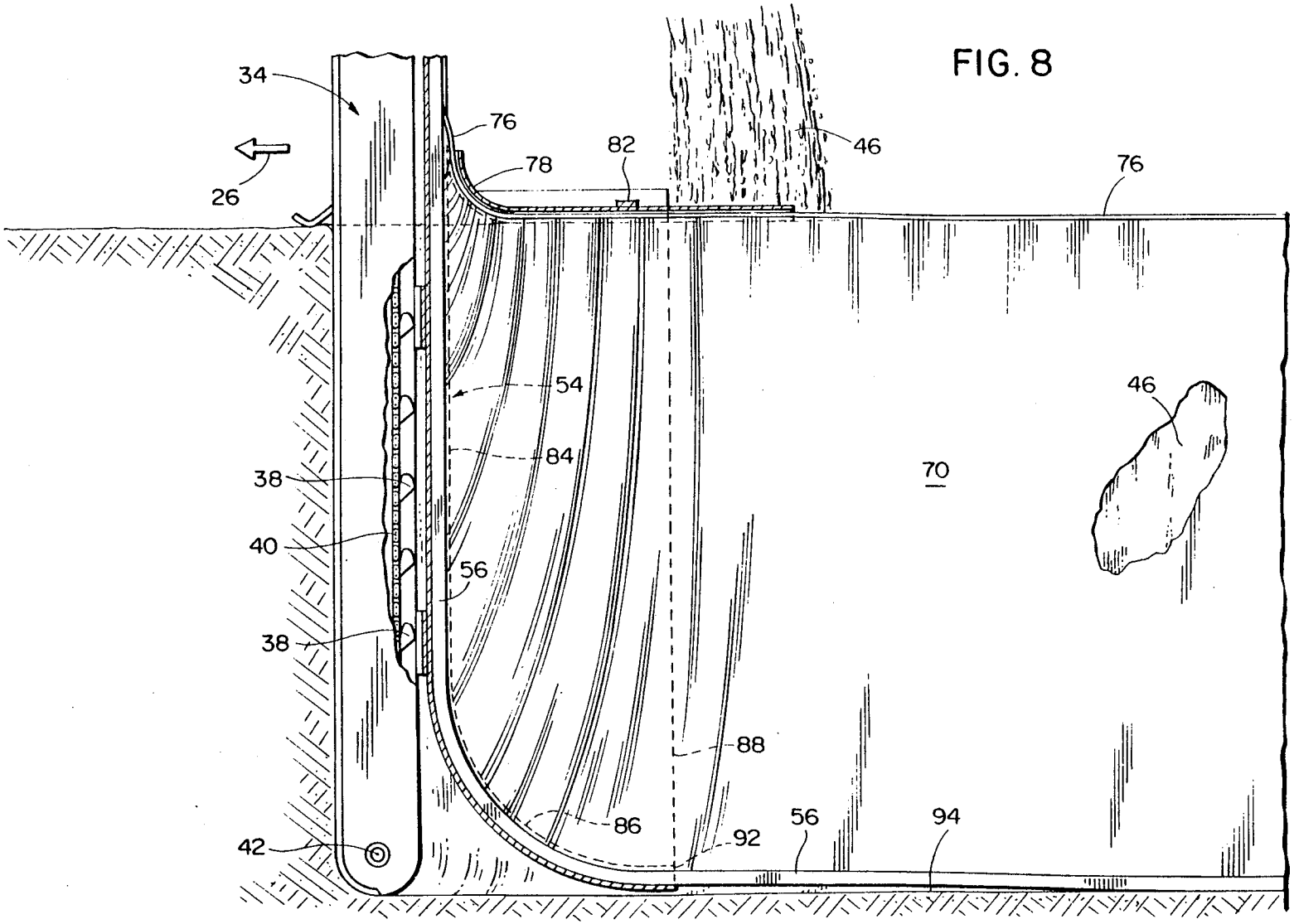
FIG. 8 is a side elevation taken partly in section of an impermeable barrier liner being released from a liner carrier case within a slotted feed tube.

As shown in FIGS. 5 and 8, the trenching tool 34 includes a plurality of digging tools 38 mounted on a chain 40 which is driven about sprockets mounted on shafts 42 located at the top and bottom of the trenching tool 34. As the trenching mechanism 20 moves in the direction of arrow 26, earth excavated by the tool 38 is conveyed upward towards the discharge chute 44 and excavated earth 46 is returned into the excavated trench from which the earth 46 originated. The trenching tool 34 is capable of digging a trench of 6 to 30 feet in depth.

The side walls 48 of the trenching tool, located on opposite sides of the digging tools 38, include struts 50 extending rearwardly from the trenching tool 34, to which are mounted parallel side plates 52 having a spacing equal to that of the side walls 48. The plates 52 form a soil retainment device which prevents the side walls of the trench from collapsing inwardly after being excavated and within which an impermeable barrier liner is extended to form a leachate containment barrier.

Extending into the soil retainment device is a slotted feed tube 54 which bends laterally from one side of the trenching tool 34 (as shown in FIG. 1) to extend between the plates 52 of the soil retainment device. Fed into the slotted feed tube is a liner carrier case 56 which is fed from a supply reel 58 mounted at a forward end 60 of the trenching mechanism 20. The reel 58 of liner carrier case 56 may carry 500 to 1,000 linear feet of the liner carrier case.

Figure 6:
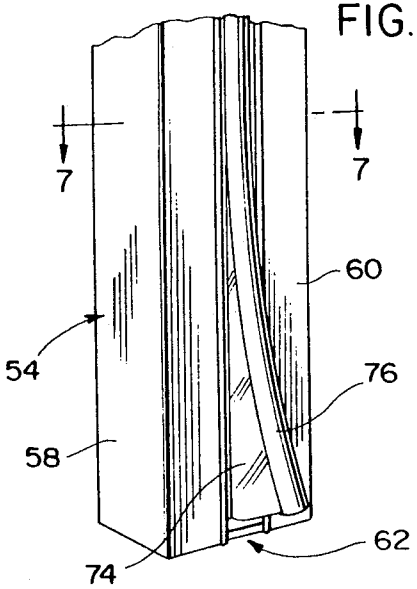
FIG. 6 is an enlarged view of a section of a slotted feed tube for a liner carrier case.
Figure 4:
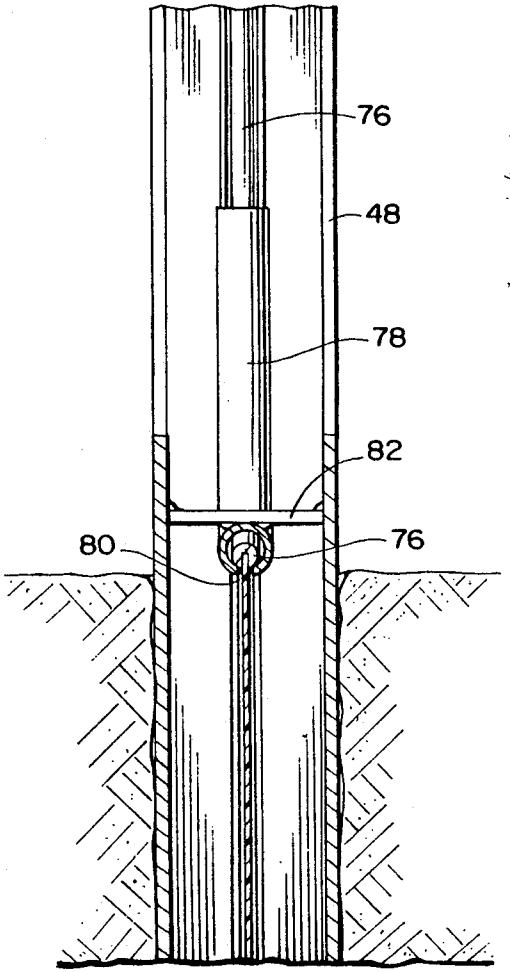
FIG. 4 is a longitudinal section taken along line 4—4 of FIG. 2.

The slotted feed tube 54, as shown in FIGS. 5 and 6, includes continuous bottom 61 and side walls 58. Its top wall 60 is divided to define a slot 62 from which is paid out an impermeable barrier liner, as will be explained later. The liner carrier case fed into the slotted feed tube 54 is of similar shape to that of the slotted feed tube 54.

The liner carrier case includes continuous bottom wall 63 and side walls 64. Its top wall 66 is divided and includes a slot 68.

The bottom wall 63 of the liner carrier case is thicker than the side walls 64 and top walls 66 and is made of a plastic material resistent to deterioration. Within the liner carrier case is an impermeable barrier liner 70 folded in an accordion style having a lowermost bottom fold 72 heat sealed to the bottom wall 63 of the liner carrier case. An opposite leading edge 74 of the liner 70 is embedded within a solid circular bar 76.

As the liner carrier case 56 is fed through the slotted feed tube 54, the bar 76 is fed into a slotted top edge catch 78. The slotted top edge catch 78 is cylindrical and includes a slot 80 defined in a lowermost portion of the catch. The slotted top edge catch 78 is supported by a bracket 82 between the panels 52 of the soil retainment device.

The slotted feed tube 54 includes a vertically extending section 84, which at a lowermost portion, forms a curved portion 86 terminating in end 92 located at the vertical edge 88 of the plates 52. Therefore, as the liner carrier case 56 enters the uppermost end 90 of the slotted feed tube 54, the liner carrier case 56 is twisted from the side to the rear of the trenching tool 34 and then fed downwardly vertically through the slotted feed tube 54 and then curving rearwardly and exiting from the slotted feed tube 54 at bottom end 92. The liner carrier case 56 is laid at the bottom 94 of a trench formed by the trenching tool 34.

Since the bottom fold 72 of the liner 70 is secured to the bottom wall 63 of the liner carrier case 56, and the leading edge 74 of the liner 70 is secured to the bar 76 which is engaged by top edge catch 78, the liner 70 is pulled from the liner carrier case as shown in FIG. 8 as the liner carrier case moves down into and out of the soil retention device. The liner 70 is spread apart to a stretched condition as shown in FIG. 8, as the liner exits from between the plates 52 of the soil retainment device.

The excavated soil 46 supports the opposite sides of the liner 70 as the excavated soil is returned to the trench on opposite sides of the liner. The bar 76 is located above ground level whereas the liner carrier case 56 is buried at the bottom of the trench with the impermeable barrier liner 70 stretching between the bar 76 and the liner carrier case 56. As the impermeable barrier liner is pulled from the liner carrier case 56 supplied from the supply reel 58, a continuous length of an impermeable barrier is formed. Adjacent sections of liner carrier case 56 and liner material 70 may be heat welded together to form a continuous length of an impermeable barrier for as great a distance as desired.

Figure 9:
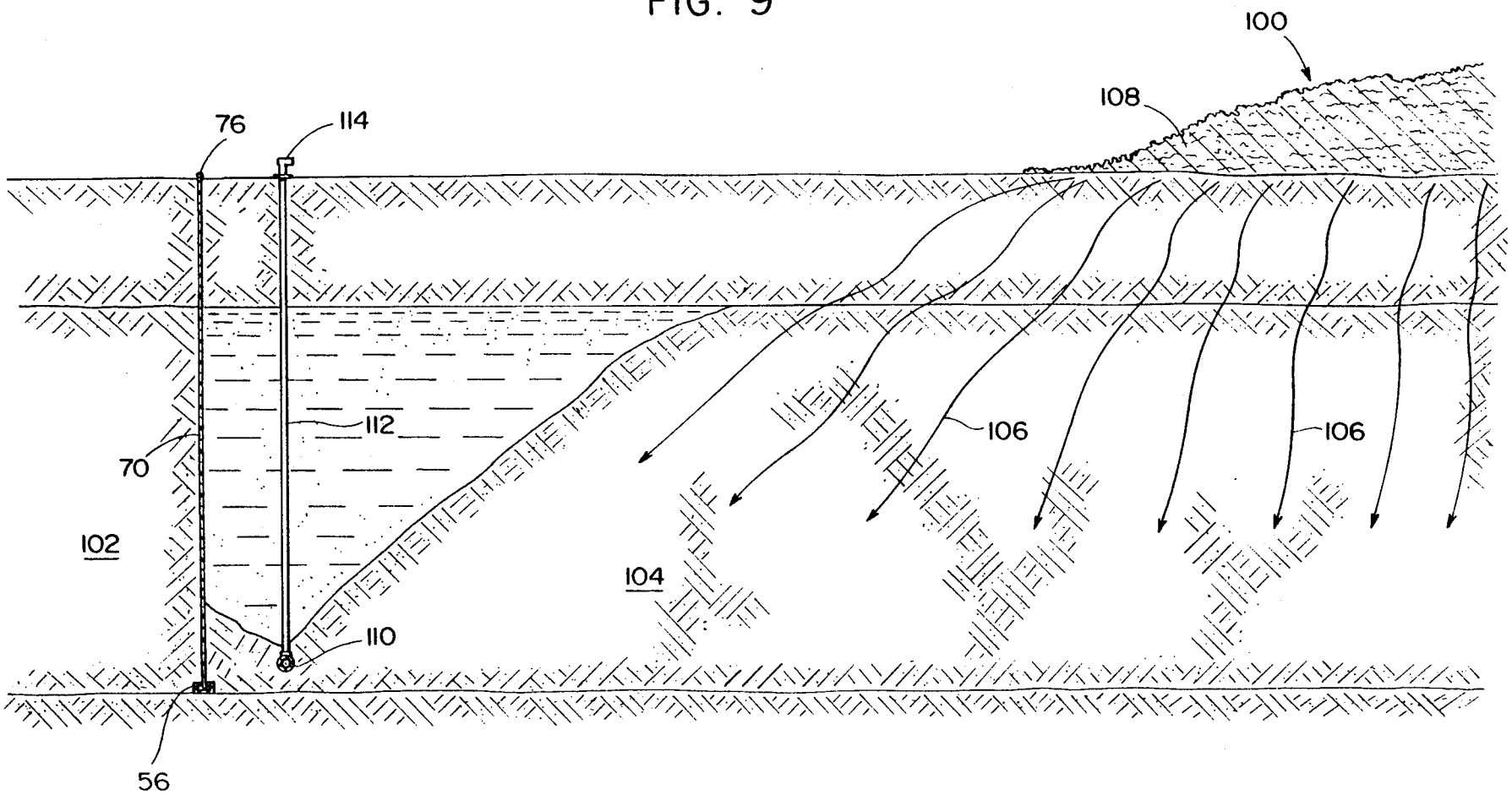
FIG. 9 is a sectional view of a leachate containment system surrounding a contaminated site.
Figure 10:
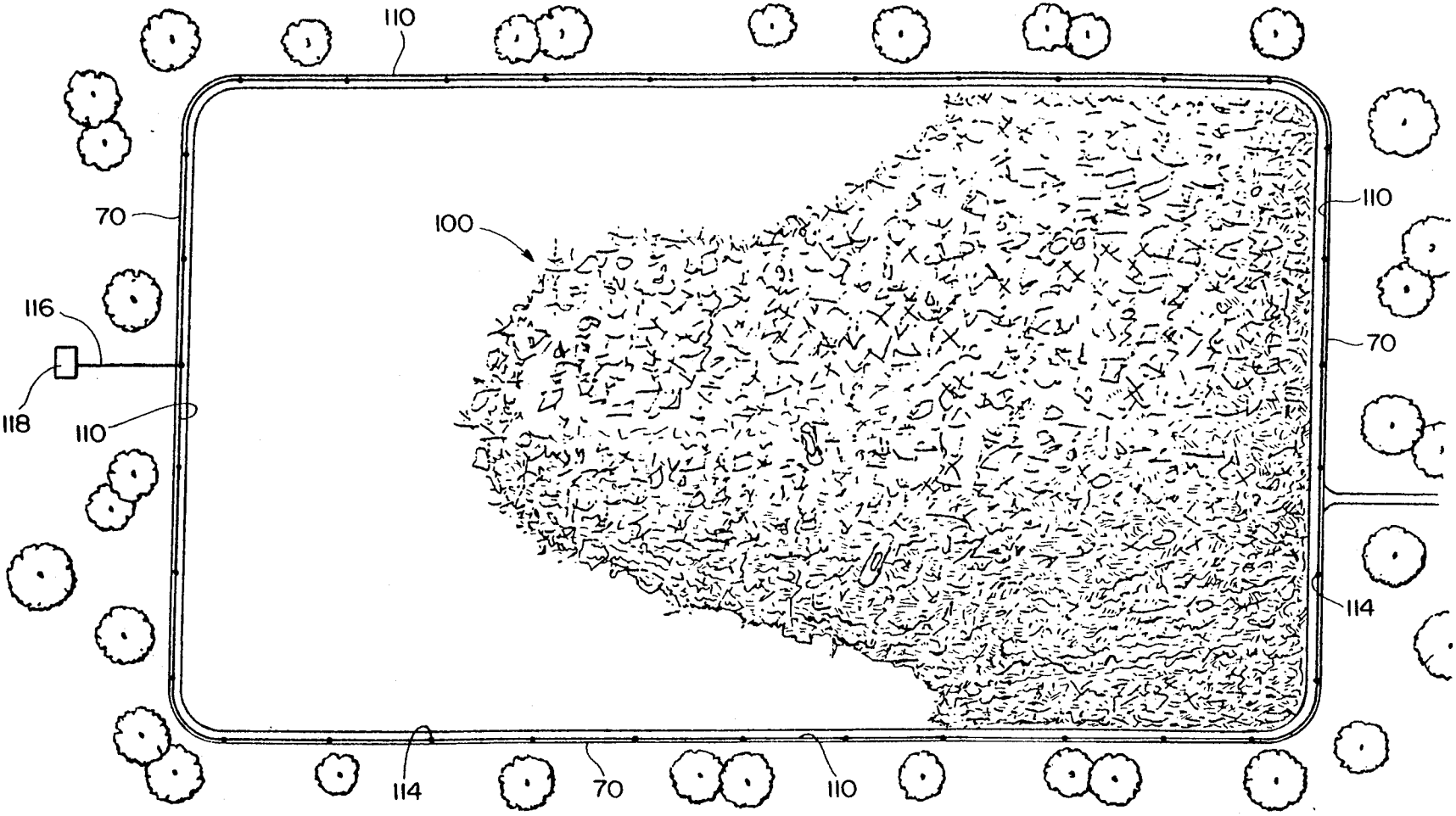
FIG. 10 is a top plan view of a leachate containment system surrounding a contaminated site.

In FIGS. 9 and 10, the leachate containment system of the present invention is shown in use to surround a contaminated site such as a landfill or a hazardous chemical dump site 100. The impermeable membrane liner 70 surrounds the entire site 100 to seal migrating ground water 102 from mixing with contaminated ground water 104 which has been contaminated by leachate agents as indicated by arrows 106, passing from the hazardous material 108 into the ground water.

In an ideal situation, the vertically installed impermeable membrane liner 70 surrounds a contaminated site 100 with the ground under the contaminated site including a naturally occurring impermeable layer such as clay. However, when such a naturally occurring impermeable layer is not present below a contaminated site, lengths of perforated pipe 110 are buried as described in U.S. Pat. No. 4,871,281, incorporated herein by reference, between the impermeable membrane liner 70 and the contaminated waste 108. The water table level within the contaminated site 100 is lowered by evacuation of water through the perforated pipe 110 having vertical headers 112 spaced approximately at 500 foot intervals and connected to above ground pumps 114 at the top of each header section 112 to pump out contaminated water within the leachate containment system isolated by the liner 70. The pumps 114 are connected to a main discharge line 116 for pump 118 to direct the contaminated water to a treatment plant.

The perforated pipes 110 reducing the level of contaminated water 104 within the liner 70 causes the ground water level outside the containment area to migrate into the containment area by passing under the liner 70 towards the perforated pipes 110. By this process, ground water is continuously moving inward towards a contaminated site from outside the liner 70, to thereby prevent escape of the contaminated water from within the liner 70.

The liner may also be used in coastal areas as an interface between salt water and fresh water to cut off the salt water intrusion of surficial aquifers.

By the leachate containment system of the present invention, any potentially harmful site can be isolated by an ASTM approved impermeable membrane liner extending from the surface to a depth of 6 to 30 or more feet. The containment area can be isolated in advance of a dumping operation or be implemented at a newly uncovered contaminated site for protection against contamination of existing ground water by leachate agents seeping into the ground water from the contaminated site.

Having described the invention, many modifications thereto will become apparent to those skilled in the art to which it pertains without deviation from the spirit of the invention as defined by the scope of the appended claims.

I claim:

1. A trenching mechanism comprising:

a trenching tool for digging a trench, drive means for conveying and powering said trenching tool, a soil retainment device mounted on said trenching tool for maintaining a trench dug by said trenching tool, and feed means for releasing a single impermeable liner from a liner carrying case into a vertically oriented position within a trench dug by said trenching tool with said liner carrying case being retained at a bottom of the trench.

2. A trenching mechanism as claimed in claim 1, wherein said feed means includes means for supplying the impermeable liner to the trench in a folded condition.

3. A trenching mechanism as claimed in claim 1, wherein said feed means includes a slotted tube located within said soil retainment device.

4. A trenching mechanism as claimed in claim 3, wherein a slotted edge catch is located at an upper portion of said soil retainment device.

5. A trenching mechanism as claimed in claim 4, wherein said slotted edge catch extends laterally from said soil retainment device.

6. An apparatus for establishing a containment system, said apparatus comprising:

a trenching tool mechanism including a trenching tool for digging a trench, drive means for conveying and powering said trenching tool, a soil retainment device mounted on said trenching tool for maintaining a trench dug by said trenching tool, and feed means for releasing an impermeable liner into a vertically oriented position within a trench dug by said trenching tool, and a liner carrying case containing a single, folded impermeable barrier liner, said feed means conveying said liner carrying case from on said trenching tool mechanism to below ground at a bottom of the trench and positioning said barrier liner to extend into a vertically extending position with said liner extending from above ground to said liner carrying case located at the bottom of the trench.

7. An apparatus as claimed in claim 6, wherein said feed means includes a slotted tube located within said soil retainment device.

8. An apparatus as claimed in claim 7, wherein a slotted edge catch is located at an upper portion of said soil retainment device.

9. An apparatus as claimed in claim 8, wherein said liner is secured to said liner carrying case at one end and secured to a bar at an opposite end, said slotted edge catch engaging said bar and said liner vertically between said slotted catch bar and said slotted tube.

10. An apparatus as claimed in claim 9, wherein said slotted tube includes a portion extending vertically from above ground and includes a portion extending horizontally during digging of a trench by said trenching tool.

11. A trenching mechanism as claimed in claim 6, wherein said liner carrying case includes a bottom wall thicker than its side walls and a top wall, said liner carrying case anchoring said liner carrying case at a bottom of a trench.

12. A trenching mechanism as claimed in claim 11, wherein said top wall is slotted.

13. In combination, an impermeable liner and an elongated carrying case adapted to be buried around a leachate containment site, said carrying case including a bottom wall, side walls extending from said bottom wall, a top wall extending from said side walls and including a slot, said impermeable liner being located within said carrying case and preventing migration of leachate from a leachate containment site, a terminal portion of said liner being secured to said bottom wall, an opposite terminal portion of said liner being secured to a bar located outside of said carrying case, said bar having a width greater than a width of said slot, and said bar extending longitudinally along said opposite terminal portion of said liner.

14. A liner and carrying case as claimed in claim 13, wherein said carrying case is located on a supply reel.

15. A leachate containment system comprising:

a contaminated site, a liner carrying case located at a bottom of a trench surrounding the contaminated site, a vertically extending impermeable liner extending from said liner carrying case to above ground level, a length of horizontally extending perforated pipe buried below the contaminated site and on a contaminated side of said liner and separated from said liner, vertically extending headers connected to said perforated pipe and extending to above ground level, and pump means for pumping out water collected in said perforated pipe so as to lower a water table below the contaminated site and draw water from a clean side of said liner towards the contaminated side of said liner to ensure against escape of contaminated water from the contaminated side to the clean side of said liner.

16. A leachate containment system as claimed in claim 15, wherein said liner extends to a depth greater than six feet.

* * * * *